United States Patent [19]

Palazzola

[11] Patent Number: 4,932,162

[45] Date of Patent: Jun. 12, 1990

[54] CAMLESS GRINDER

[76] Inventor: Anthony Palazzola, 6371 Oakhill Rd., Ortonville, Mich. 48462

[21] Appl. No.: 323,299

[22] Filed: Mar. 14, 1989

[51] Int. Cl.[5] ..... B24B 3/20

[52] U.S. Cl. ..... 51/5 D; 51/95 R; 51/98.5; 51/325

[58] Field of Search ..... 15/97 B, 53 AB; 51/217 R, 5 D, 207, 93, 95 R, 75 WH, 103 R, 93, 98.5, 105 EC, 92 ND, 325

[56] References Cited

U.S. PATENT DOCUMENTS

| | | | |
|---|---|---|---|
| 3,269,381 | 8/1966 | Healy | 51/5 D |
| 3,753,430 | 8/1973 | Oas | 51/207 |
| 4,151,684 | 3/1979 | Wada et al. | 51/5 D |
| 4,424,602 | 1/1984 | Belanger et al. | 15/53 AB |
| 4,570,386 | 2/1986 | Unno et al. | 51/5 D |
| 4,607,460 | 8/1986 | Mushardt | 51/5 D |
| 4,709,514 | 12/1987 | Chase et al. | 51/5 D |
| 4,735,019 | 4/1988 | Wiederkehr | 51/93 |
| 4,787,177 | 11/1988 | Scalia | 51/217 R |
| 4,805,585 | 2/1989 | Halvorsen | 51/5 D |

OTHER PUBLICATIONS

Unison Model 1000 Brochure, Unison Corp. Ferndale, Mich., No Date.

Harvill 500 Series Insert Grinder, Harvill, Hazel Park, Mich., No Date.

*Primary Examiner*—Frederick R. Schmidt

*Assistant Examiner*—Mark F. Frazier

*Attorney, Agent, or Firm*—Dykema Gossett

[57] ABSTRACT

A method and apparatus has been disclosed for grinding contour punch parts. The apparatus is capable of movement on six axes. The main features of the invention include stopping rotation of the part when a flat surface is desired to be ground on the part and moving it directly vertically upwardly with respect to the grinding wheel, thus forming a smooth flat surface on the part. The part is moved on three axes, laterally, horizontally and vertically with respect to the grinding wheel. In addition, a dressing apparatus, movable on two axes, is disposed behind the grinding wheel and maintains a desired surface upon the grinding wheel. The dressing surface may form a ramp surface on the grinding wheel that will create a ramp surface on the finished part.

19 Claims, 3 Drawing Sheets

CAMLESS GRINDER

BACKGROUND OF THE INVENTION

This invention in general relates to grinding machines. In particular, the invention relates to an improved contour punch grinder for use in grinding metal punches.

Metal punches are utilized to punch apertures into sheet metal. The prior art machines for grinding a metal punch would pivot a metal blank into and away from the grinding wheel in order to shape the proper surface on the blank. A prior art grinding apparatus is shown in FIGS. 1 and 2. Prior art grinding apparatus 20 includes a cam 24 and a cam surface 26. Cam 24 was mounted upon a shaft 28 that rotated integrally with part holder 32. A motor rotates shaft 28, cam 24 and part holder 32. Shaft 28 and part holder 32 were mounted within main body 30, and part holder 32 had a part 34 to be ground mounted therein. As shown in FIG. 1, main body 30 is mounted to fixed base 36. Grinding wheel 38 and grinding wheel cover 40 are shown horizontally aligned with part 34.

As shown in FIG. 2, cam 24 will rotate against cam surface 26 which is fixed to stationary surface 42. Main body part 30 is pivotally mounted to base 36 as shown by pin 44. Main body 30 is weight-biased to pivot into the wheel and thus cam 24 is biased into surface 26. However, the cam shape will cause the cam 24 and main body 30 to pivot against this bias whenever a relatively large diameter portion of the cam is in contact with the cam surface. Cam 24 would rotate along cam surface 26 and cause main body 30 to pivot clockwise and counterclockwise about pin 44. Part holder 32' and part 34 would be moved therewith into and away from grinding wheel 38. Thus, by properly shaping cam 24, a desired surface can be formed upon contour punch part 22.

This type of prior art device was unsatisfactory since a cam needed to be manufactured for any run of contour punches that was to be manufactured. This is not particularly expensive if a large number, say thousands or hundreds of thousands, of the contour punches were to be manufactured; however, if only a small number of punches were to be manufactured it would be unduly expensive to create a cam such as shown at 24.

One prior art device attempted to solve this problem by computerizing a motor to pivot main body part 30 into and away from grinding wheel 38. This was also unsatisfactory since the computer program was extremely complicated and required the introduction of several variables.

A contour punch as is commonly found in industry is shown in FIG. 3. This punch consists of a main body portion 46 that may sometimes have a ramp portion 48 extending between main body portion 46 and a flat planar surface 50. A lock nut indentation 52 is formed near one end 54, the planar surface 50 being formed at the other end 56. In contour punch 22, surfaces 48 and 50 have been formed by a grinding wheel while main portion 46 is relatively unground and retains its original shape. When utilizing a prior art grinder that pivoted, a flat planar surface, such as shown at 50, will have wavy surfaces. The prior art grinding wheels were not capable of grinding a completely flat surface by merely pivoting into and away from the grinding wheel.

It is therefore an object of the present invention to create a grinding apparatus that will allow the use of either a cam or a computer control to control the movement of the contour punch part holder into and away from the grinding wheel.

It is further an object of the present invention to create a contour punch grinder apparatus that will grind a perfectly flat surface when one is desired upon a particular contour punch.

Moreover, it is an object of the present invention to achieve these goals with an apparatus that is relatively simple and economical.

SUMMARY OF THE INVENTION

The present invention discloses a contour punch grinder that utilizes movement upon six different axes to ensure that the final contour punch will have a desire surface.

The contour punch grinder of the present invention achieves these goals by having a main body portion that is guided for movement along all three dimensions. That is, the main body may be moved directly vertically, horizontally, and laterally. In addition, a contour punch part holder is rotatably mounted within the main body and is driven by a rotating motor.

Thus, when it is desired to grind a particular surface on a contour punch, the main body is brought horizontally into alignment with a grinding wheel and then moved laterally into contact with the grinding wheel. The part is held in contact with the grinding wheel, and it is rotated to create any curved surfaces that may be desired on the contour punch. The movement of the main body and the contour punch part holder may be controlled by a cam, or it may be computer controlled. If a cam is used, some computer control is envisioned for driving the various motors.

When it is desired to create a flat surface upon a particular contour punch the part holder is first prevented from rotating and maintained in a static position. The part is then brought into contact with the grinding wheel, and the vertical movement motor of the main body of the contour punch grinder apparatus is activated to move the entire body of the contour punch grinder vertically upwardly or downwardly. This will bring the associated contour punch part holder and contour punch along therewith. The contour punch is thus caused to move vertically along the grinding wheel while not rotating. Due to this movement, an entirely flat surface will be created on the contour punch. Although vertical movement is preferably used to create the flat surface, horizontal movement may also be acceptable.

The main body of the contour punch grinder apparatus has a first motor for lateral movement with respect to the grinding wheel, a second motor for horizontal movement with respect to the grinding wheel, and a third motor for vertical movement with respect to the grinding wheel.

An additional feature of the invention consists of having a high-pressure gas jet applied against the main body to bias it into contact with a laterally furthermost position in the direction of the grinding wheel. In the event that the part or grinding wheel seizes and an overly large force is applied to the body, the body will move away from the wheel and against the force of the high-pressure jet and relieve the seizure of the part or wheel.

A further aspect of the present invention is a dresser apparatus for accurately maintaining the desired surface on the grinding wheel. The dresser apparatus of the present invention consists of a diamond-tipped dresser member that is brought into and out of contact with a rear portion of the grinding wheel. The dresser member is moved into contact with the wheel in order to grind off a surface of the wheel. A second motor moves the dresser apparatus laterally along the wheel. By entering the desired surface of the grinding wheel into the computer control, the control will then position the diamond-tipped dresser member against the grinding wheel to form any ramps or the like that may be desired upon the grinding wheel and the final contour punch.

The method of the present invention consists of horizontally and laterally aligning the part with the grinding wheel and controlling the movement of the various motors on the main body part to grind down the contour punch part to a rough approximation of its final shape. The part is then moved away from the grinding wheel, and the dresser assembly is brought into contact with the wheel in order to accurately shape a desired surface face upon the grinder wheel. Once the dresser assembly has accurately formed the desired face upon the grinder wheel, the part is then brought back into contact with the grinding wheel, and a finished grind is performed. It is to be understood that several increments of this dressing and finish grinding may be performed in order to more accurately shape the finished contour punch to the desired dimensions. Whenever a flat surface is desired upon the contour punch, the rotary motor driving the part holder is stopped, and the part is moved vertically with respect to the grinding wheel. This causes the part to have a finished flat surface that is smooth.

Further objects and features of the present invention can be best understood from the following specification and drawings, of which the following is a brief description thereof.

DETAILED DESCRIPTION OF A DISCLOSED EMBODIMENT

Figure 3:
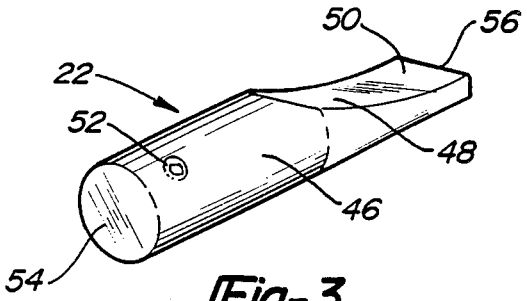
FIG. 3 shows a contour punch.

This invention discloses an improved contour punch grinder 60 for use in forming contour punches such as shown at 22 in FIG. 3.

Figure 4:
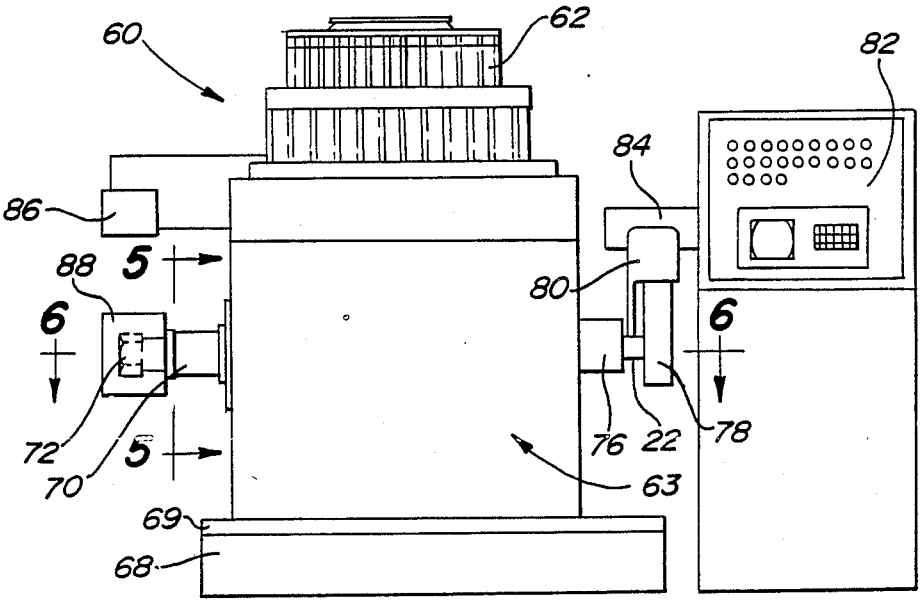
FIG. 4 shows a side view of the improved contour punch grinder apparatus of the present invention.

Contour punch grinder 60 consists of a motor 62 for moving a main body 63 vertically upwardly and downwardly with respect to a grinder wheel. Main body 63 is mounted for movement on fixed base 68. Table 69 moves main body 63 horizontally, as shown in FIG. 4, with respect to base 68. Table 69 is driven by a motor, not shown. A cam 72, similar to the prior art cams, may be utilized with the improved grinder 60. However, a cam is not necessary. Cam 72 is mounted upon shaft 70 which is in turn mounted to part holder 76. Part holder 76 holds contour punch part 22.

Grinder wheel 78 and grinder wheel cover 80 are mounted on a first axis in the vicinity of part 76. For the purpose of the description included in this disclosure, the direction "laterally with respect to the grinder wheel" refers to movement into and out of the paper as shown in FIG. 4. The use of the words "vertically" and "horizontally" refers to movement with respect to the grinding wheel as illustrated in FIG. 4.

A computer control is illustrated at 82 and acts to control the various motors and members of the grinder apparatus 60. The details of this control are not part of this invention. A worker in the art could assemble an adequate control.

A grinder wheel dresser apparatus 84 is mounted laterally behind grinder wheel cover 80.

A source of pneumatic pressure 86 is associated with contour punch grinder apparatus 60.

An abutment 88 serves to move main body 63 laterally, or into an out of the paper as shown in FIG. 4. As can be seen, abutment 88 is vertically larger than cam 72.

Figure 1:
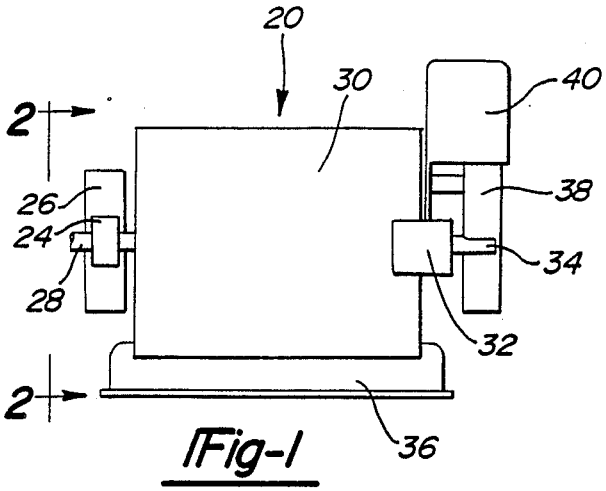
FIG. 1 shows a side view of a prior art contour punch grinder.
Figure 2:
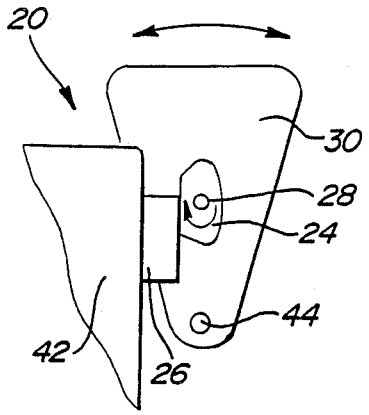
FIG. 2 is an end view along line 2—2 of FIG. 1.
Figure 5:
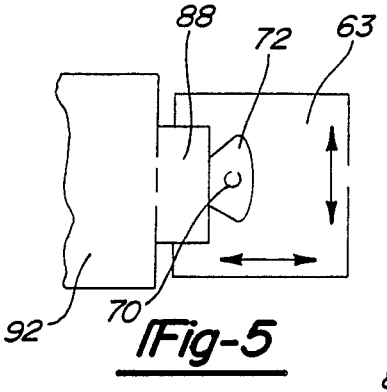
FIG. 5 shows an end view along lines 5—5 of FIG. 4.

FIG. 5 is a view similar to that shown in FIG. 2, but illustrating the movement of the contour punch grinder 60 of the present invention. As can be seen in FIG. 5, a cam 72 may ride along abutment 88 which is connected to motor 92. Main body 63 can be seen to be capable of movement in both the lateral and vertical directions. Thus, in the improved contour punch grinder 60 of the present invention, the main body does not pivot; however, it is guided both laterally and vertically. As is also seen from FIG. 5, cam 72 and shaft 70 are rotatably driven within main body 63.

Figure 6:
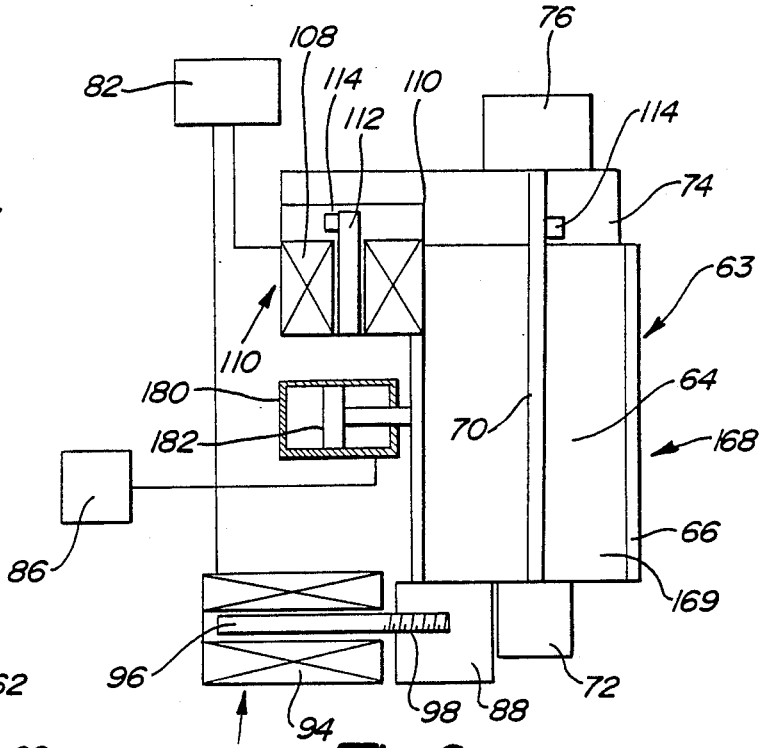
FIG. 6 is a partly schematic cross-sectional view along line 6—6 of FIG. 4 showing the various motors that drive the main portion of the present invention.

A first embodiment is shown largely schematically in FIG. 6, main body 63 can be moved laterally, vertically, and also horizontally. Main body 63 consists of inner body 64 and outer body 66. A first motor 92 causes the main body 63 to be moved laterally with respect to the grinding wheel, "laterally" being defined as shown in FIG. 4.

A first motor 92 consists of a rotary motor 94 with a shaft 96 having the screw thread 98 guided in abutment 88. Abutment 88 is prevented from rotating and the resulting connection is a rotary to reciprocating connection. The exact motor structure forms no part of the invention and is well known in the art. Thus, when control 82 causes motor 94 to rotate screw thread 98 rotates within abutment 88 and causes abutment 88 to reciprocate laterally. Since abutment 88 is in contact with cam 72 which is in turn mounted within main body 63, the entire main body is moved laterally by abutment 88. However, there is no positive mechanical connection between abutment 88 and cam 72. Thus, abutment 88 only causes cam 72 to move main body 63 away from the grinding wheel. An air cylinder 180 is connected to a pressure air source 86. Pressure air source 86 sends high-pressure air against a piston 182 which is mounted within chamber 180. Piston 182 is connected to outer body 66 and thus causes the entire main body 63 to be brought towards the grinding wheel.

When laterally positioning main body 63, motor 92 causes abutment 88 to abut cam 72 and move body 63 in a direction away from the grinding wheel. Alternatively, when it is desired to move main body 63 towards the grinding wheel, cylinder 180 is sued and piston 182 is biased towards the grinding wheel and brings body 63 along. It is to be understood that when it is desired to move body 63 towards the grinding wheel, abutment 88 is moved laterally towards the grinding wheel also. Thus, cam 72 can move along with main body 63 in the direction of the grinding wheel and will not abut abutment 88. Should a seizure occur between the wheel and the part, body 63 will be forced against the biased on piston 180 and move away from the grinding wheel.

A motor 110 is mounted to the side of inner body 64 and causes part holder 76 and cam 72 to rotate. Motor 110 consists of a rotary motor 108 that drives a shaft 112. A belt 114 connects shaft 112 with shaft 70. A belt guard 74 covers this belt connection. As can be seen, outer housing 66 is cut away in the vicinity of motor 110 to allow motor 110 to be mounted directly to inner body 64. Alternatively, motor 110 could be mounted to outer body 66 and the tightness of belt 114 would simply vary as part holder 76 is moved vertically.

Figure 7:
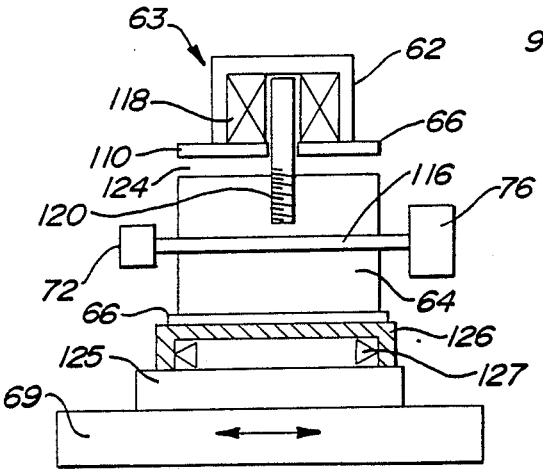
FIG. 7 is a partly schematic cross-sectional view.

Rotary motor 62 provides movement of main body 63 in a third direction. As shown in FIG. 7, a rotary motor 118 is mounted upon outer body portion 66. A screw thread portion 120 rotates integrally along with rotary motor 118 and is mounted within inner body portion 64. Since inner body portion 64 is about the same lateral size as outer body portion 66 it is prevented from rotating. Thus, the rotation of threaded surface 120 within inner body portion 64 will cause it to advance vertically both upwardly and downwardly with respect to outer body portion 66. Basically, outer body 66 surrounds inner body 64 on all but the horizontal sides. Alternatively, there could simply be an opening in outer housing 66 that allows the cam and the part holder to move vertically with respect to the outer housing. Inner body portion 64 is of a smaller vertical dimension than outer body portion 66. This creates a clearance 124 that allows the inner portion 64 to move within the outer portion 66. Alternatively, any other type of rotary-to-reciprocating motor may be utilized rather than the one illustrated at 62 in FIG. 7.

Also shown in FIG. 7 is the mounting of body 63 with respect to moving table 69. As shown by the arrow, table 69 can move horizontally in either direction and body 63 will move along therewith. A portion 125 of table 69 has a railing 126 slidably mounted thereon. Railing 126 can move laterally with respect to portion 125. Point bearings 127 are mounted so as to guide railing 126 upon portion 125. This connection allows main body 63 to be moved laterally with respect to portion 125 and thus table 69.

Figure 8:
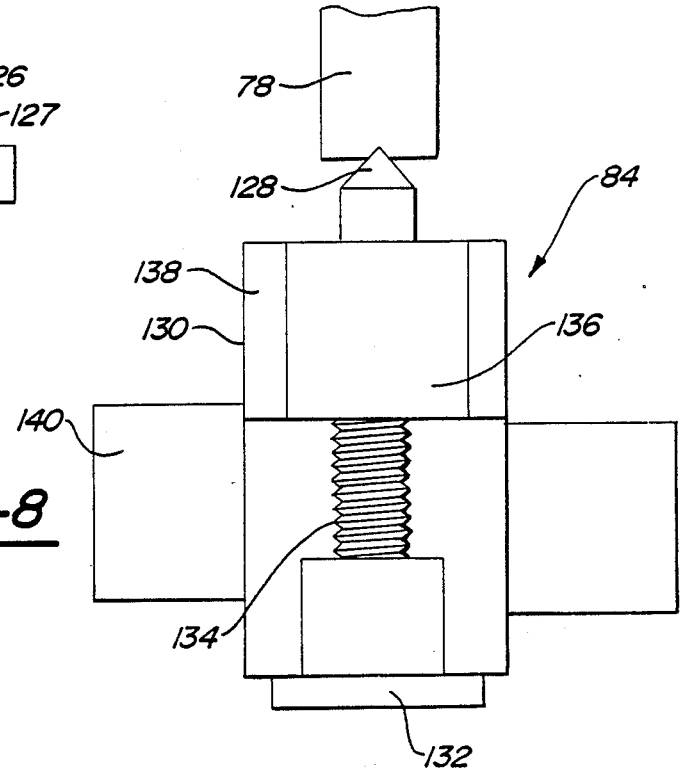
FIG. 8 is a top view showing the details of the dresser assembly of the present invention.

FIG. 8 shows a dresser assembly 84 for use in creating a desired surface along grinder wheel 78. Dresser assembly 84 consists of a diamond-tipped needle 128 mounted within a first housing 130. Rotary motor 132 having a spiral surface 134, similar to that disclosed above for motor 62, is received within part 136. Part 136 fixedly holds diamond tip 128. Guide shoulders 138 prevent rotation of part 136 and thus cause part 136 to reciprocate into and out of housing 130. The reciprocation causes diamond tip 128 to be brought into contact with grinder wheel 78 and may cause diamond tip 128 to be brought radially further into contact with grinder wheel 78. A second motor 140 causes the entire dresser assembly 84 to move along the surface of grinder wheel 78. Thus, diamond tip 128 can create a desired surface upon grinder wheel 78 by being moved within housing 130 further into or away from grinder wheel 78 and by being moved horizontally along the surface thereof.

Figure 9:
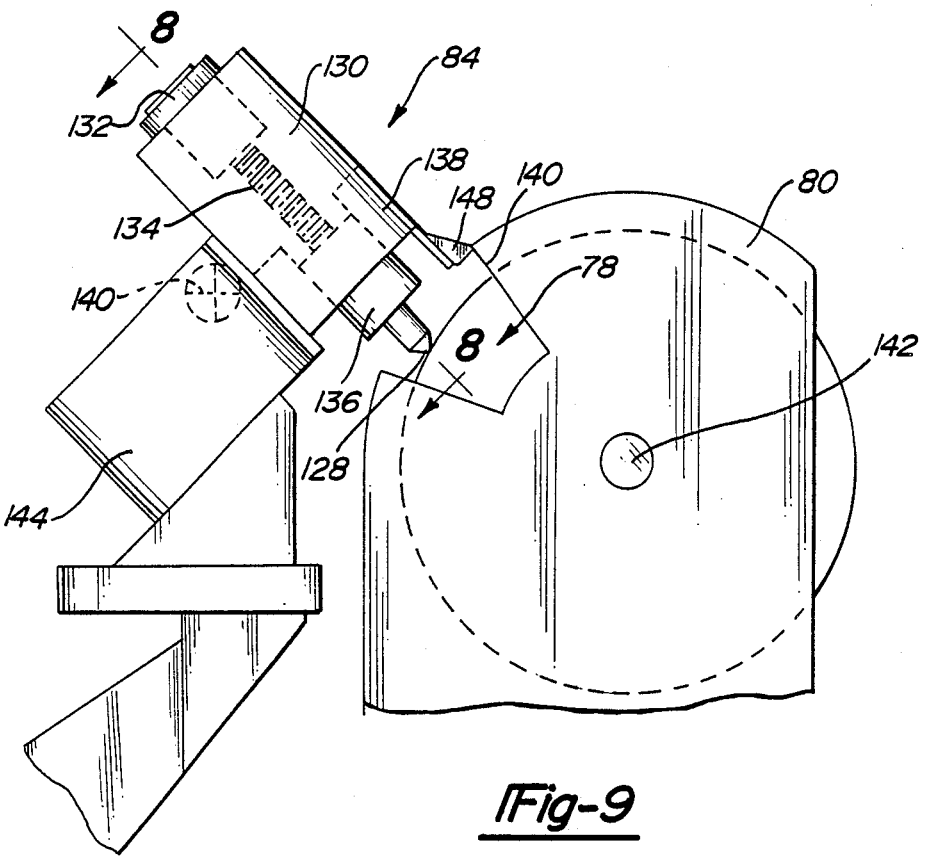
FIG. 9 is a view perpendicular to that of FIG. 8 showing further details of the dresser assembly of the present invention.

As shown in FIG. 9, grinder wheel 78 has grinder wheel cover 80 and is rotatably mounted on axis 142. Dresser assembly 84 consists of diamond tip 128, outer housing 130, rotary motor 132, spiral surface 134, part 136, guide shoulders 138, and second motor 140. The entire grinder assembly 84 is mounted for movement upon fixed base 144. The details of the mount between dresser assembly 84 and fixed base 144 are not important to this invention and could be of any type that would allow the movement described above. A further feature of grinder cover 80 is notched portion 146 that allows access to grinder wheel 78 from diamond tip 128. An alignment notch 148 integral with housing 130 ensures that diamond tip 128 is properly positioned with respect to grinder wheel 78. That is, notch 146 receives flange 148 to ensure the proper positioning of diamond tip 128.

Figure 10:
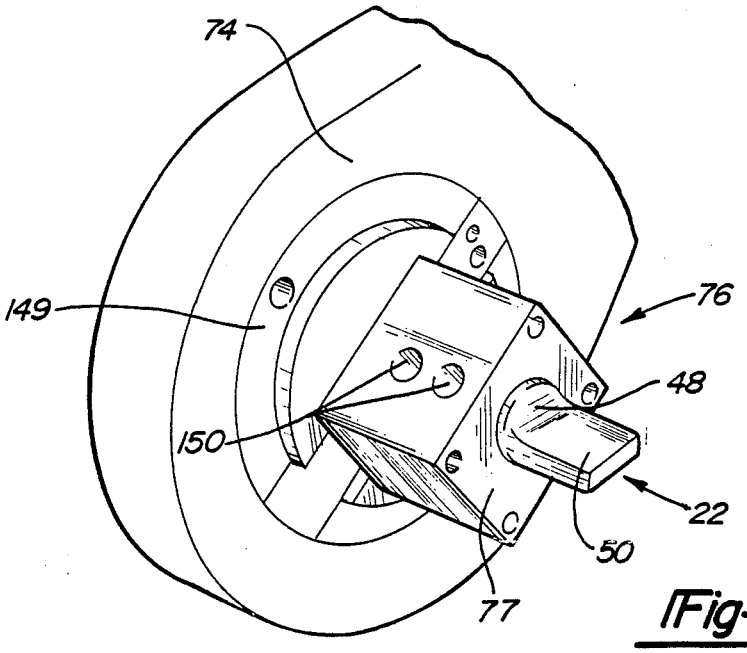
FIG. 10 shows the part holder of the present invention.

FIG. 10 shows the part holder apparatus 76 and part lock member 77. Part lock member 77 firmly receives part 22. Ramp 48 and flat portion 50 can be seen to extend beyond part lock member 77. A central portion 149 will rotate along with belt 114 and includes part lock member 77. Notches 150 receive Allen screws or the like and align with indent 52 formed in part 22. The holes 150 and indent 52 ensure proper placement of part 22 within part lock 77. The part lock connection ensures that part 22 will be accurately positioned with respect to grinding wheel 78 while the grinding operation is in progress.

The grinding operation will now be described with respect to FIGS. 3 to 10. When a desired contour punch is to be manufactured, the basic desired parameters will be entered into control 82. The details of control 82 are not important to this invention, and the worker in the art could understand how to achieve the required controls. A part blank to be ground is inserted in part lock 77, holes 150 and indent 52 ensuring proper alignment. Part lock 77 is then brought into alignment with grinding wheel 78 along with main body 63. Initial grinding is commenced, and part lock 77 is rotated along grinding wheel 78 to create any curved surfaces that may be desired. The part lock 77 and the associated part 22 are moved laterally and horizontally with respect to grinding wheel 78 while the part lock 77 is being rotated in order to form the desired surface upon part 22.

If it is desired to have a flat surface, such as shown at 50 in FIG. 3, formed on the part 22, the rotary motor 110 is stopped. Rotary motor 62 is energized, inner portion 64, part lock 77, and associated part 22 are moved vertically along grinding wheel 78. This causes a smooth flat surface 50 to be formed upon punch 22.

If a ramp, such as shown at 48, is desired, the wheel 78 is initially shaped to form the ramp. This shaping is described below.

Once the rough grinding has been done, the part lock 77 and associated part 22 are moved away from grinding wheel 78. Dresser assembly 84 is then brought into contact with grinding wheel 78 to accurately form a desired surface upon grinding wheel 78. If, for instance, a ramp, such as shown at 48 in FIG. 3, is desired upon the final contour punch, the dresser assembly and the associated diamond tip 128 will be utilized to form the correct surface upon grinding wheel 78.

In forming a ramp such as shown at 48, diamond tip 128 would be kept relatively withdrawn into housing 130 at the lefthand side of grinding wheel 78, as shown in FIG. 8, and moved out of housing 130 into grinding wheel 78 as it moves to the right along grinding wheel 78. Thus, by moving diamond tip 128 further into grinding wheel 78 as diamond tip 128 moves from left to right along grinding wheel 78, the surface of grinding wheel 78 would have a ramp-like configuration roughly approximating the desired ramp 48 on contour punch 22. It is to be understood that the surface of grinding wheel 78 would be the mirror image of the ramp 48 desired on the part. That is, where the ramp 48 is at its thickest extent near main part 46, the wheel 78 would be at its smallest diameter. At the tail end of ramp 48, near flat surface 50, the grinding wheel 78 will be maintained at a greater diameter. This ramp forming may also be performed prior to any rough grinding.

The dresser assembly 84 may also be utilized simply to ensure the surface of grinder wheel 78 is maintained relatively level along its extent. That is, the rough grinding of part 22 may cause gauges or nicks in the surface of grinding wheel 78 that will be corrected by dresser assembly 84.

Once dresser assembly 84 has accurately formed the desired surface on grinder wheel 78, part 22 is brought back into contact with grinder wheel 78 and the finish grinding is begun. Finish grinding is performed exactly as has been described above with respect to the rough grinding.

It is to be understood that three or four iterations of this dressing and subsequent grinding may be performed in order to achieve a final contour punch.

The teachings of this invention will apply to any type of grinding, and in particular anytime it is desired to grind ramps and flat surfaces.

Preferred embodiments of the present invention have been disclosed; however, they are not intended to limit the scope of the invention. The following claims should be read in order to determine the exact scope of the invention claimed herein.

What is claimed is:

1. A method of grinding a part that may have ramps and flat portions comprising the steps of:

(A) rotating a grinding wheel on a first axis;

(B) rotating a part to be ground on a second axis, the second axis being parallel to the first axis;

(C) bringing the part into contact with the grinding wheel and rotating the part and the grinding wheel to grind material from the part;

(D) controlling the rotation of the part by identifying desired flat portions on the part and stopping rotation of the part when a desired flat portion will be in contact with the grinding wheel; and (E) moving the part directly vertically upwardly while maintaining it in contact with the rotating grinding wheel and stopping the part from rotating to form a flat surface upon the part.

2. A method as recited in claim 1, and further wherein the grinding wheel is periodically dressed during a grinding operation in order to have a desired surface shaped that will form any ramp portions that may be desired on the part, and removing the part from contact with the grinding wheel while this dressing is going on.

3. A method as recited in claim 2, and further wherein the part is brought into contact with the grinding wheel after this dressing step has been completed.

4. A method as recited in claim 1, and further wherein the grinding wheel is periodically dressed during a grinding operation in order to ensure a desired surface shape on the wheel.

5. A grinding apparatus comprising:

a fixed base;

a grinding wheel mounted on said base and driven for rotation on a first axis;

a main body mounted laterally spaced from said wheel;

a part holder rotatably mounted within said main body;

a motor for rotating said part holder within said main body;

means for positioning said part holder such that a part mounted in said part holder will be in contact with said grinding wheel; and means for moving said part holder along said grinding wheel through a plane perpendicular to said first axis while said motor is inoperative to create a flat surface on said part.

6. A grinding apparatus as recited in claim 5 and further wherein said means for positioning said part holder include a lateral motor for moving said main body laterally with respect to said grinding wheel and a horizontal motor for moving said main body horizontally with respect to said grinding wheel.

7. A grinding apparatus as recited in claim 6 and further wherein said lateral motor is a rotary-to-reciprocating motor.

8. A grinding apparatus as recited in claim 5 and further wherein said means for moving said part holder include a vertical motor for moving said main body vertically with respect to said grinding wheel.

9. A grinding apparatus as recited in claim 8 and further wherein said vertical motor includes a rotary-to-reciprocating motor.

10. A grinding apparatus as recited in claim 5 and further comprising biasing means biasing said part holder laterally toward said wheel, a seizure or the like causing a force in opposition to said biasing means that will move the part holder away from the wheel and relieve the seizure.

11. A grinding apparatus as recited in claim 5 and further comprising means for maintaining a desired surface on said wheel, said means for maintaining a desired surface including a dresser apparatus.

12. A grinding apparatus as recited in claim 11 and further wherein said dresser apparatus includes a diamond-tipped needle, a first motor selectively moving said diamond-tipped needle towards and away from said grinding wheel, a second motor moving said dresser apparatus horizontally with respect to said grinding wheel.

13. A grinding apparatus as recited in claim 12 and further wherein said diamond-tipped needle is moved into said grinding wheel to create a desired surface upon said grinding wheel, a control means controlling said motors of said dresser apparatus to cause said diamond-tipped needle to form the desired surface on said grinding wheel, said motor for moving said diamond-tipped needle into and away from said grinding wheel includes a rotary-to-reciprocating motor, said dresser apparatus having a flange and said grinding wheel having a notch that slidably receives said flanges to ensure proper positioning.

14. A grinding apparatus as recited in claim 11 and further comprising biasing means biasing at least said part holder laterally toward said wheel.

15. A grinding apparatus as recited in claim 14 and further wherein said biasing means is pressurized air.

16. A grinding apparatus as recited in claim 5 and further wherein said motor for rotating said part holder within said main body consists of a rotary motor mounted to a portion of said main body, said rotary motor rotating a shaft, said shaft having a belt operably connected so as to rotate said part holder.

17. A grinding apparatus as recited in claim 5 and further wherein:

said means for positioning said part holder include a lateral motor for moving said main body laterally with respect to said grinding wheel and a horizontal motor for moving said main body horizontally with respect to said grinding wheel;

said lateral motor consisting of a rotary motor rotating a shaft, said shaft having a screw thread formed at a first axial extent thereof;

said screw thread being received within an abutment member;

said abutment being prevented from rotating along with said shaft;

rotation of said screw thread of said shaft within said abutment causing said abutment to be reciprocated;

a portion of said main body being normally in contact with said abutment;

reciprocation of said abutment away from said grinding wheel causing said main body to move along therewith laterally away from said grinding wheel; and said means for positioning further comprising a biasing means consisting of an air cylinder having a high-pressure air source connected thereto, said high-pressure air source causing pressurized air to impinge upon a piston, said piston being connected to said main body, the connection of high-pressure air to said piston causing said main body to move in a direction towards said grinding wheel, no mechanical connection existing between said abutment and said main body thus allowing said biasing means to be the sole force holding said main body in contact with said grinding wheel, a seizure or the like causing an abnormally large force upon said main body will overcome said biasing means and allow said main body to move laterally away from said grinding wheel.

18. A grinding apparatus as recited in claim 5 and further wherein:

said main body consisting of an inner body and an outer body portion;

said means for positioning said part holder including means for laterally moving said main body and means for horizontally moving said main body; and said means for laterally and horizontally moving said main body moving both said inner and outer body portions of said main body, said means for moving said part holder such that a part is moved along said grinding wheel consisting of means for moving said part holder vertically with respect to said grinding wheel, said means for moving said part holder vertically only moving said inner body portion vertically with respect to said grinding wheel.

19. A grinding apparatus comprising:

a fixed base;

a grinding wheel mounted on said fixed base and driven for rotation on a first axis;

a dresser apparatus for maintaining a desired surface on said grinding wheel, said dresser apparatus including a diamond-tipped needle, said diamond-tipped needle being driven by a first motor into and away from said grinding wheel in order to cut a desired surface into the face of said grinding wheel, said diamond-tipped needle being driven horizontally with respect to said grinding wheel to allow said diamond-tipped needle to cut the desired surface along the entire face of said grinding wheel, said diamond-tipped needle being moved into and away from said grinding wheel by a rotary-to-reciprocating motor;

a main grinding wheel mounted laterally spaced from said body, biasing means biasing said body laterally towards said grinding wheel, said biasing means including high-pressure gas;

a part holder rotatably mounted within said body, said part holder having alignment means for ensuring that a part to be ground is accurately positioned therein;

a motor mounted within said body for rotating said part holder;

means for positioning said part holder such that a part to be ground mounted therein will be in contact with said grinding wheel, said means for positioning including a lateral motor and a horizontal motor, said lateral and horizontal motors being pneumatic motors having pistons and piston chambers; and means for moving said part holder such that a part mounted therein is moved vertically along said grinding wheel to create a flat surface on said part to be ground, said means for moving including a rotary-to-reciprocating motor for moving said body and said associated part holder directly vertically upwardly, said motor for rotating said part holder being disengaged while said vertical movement is being performed.

* * * * *